US005819877A

United States Patent [19]

Rivera et al.

[11] Patent Number: 5,819,877

[45] Date of Patent: Oct. 13, 1998

[54] ELEVATOR EVACUATION DETERRENT DEVICE

[75] Inventors: James A. Rivera; Richard E. Kulak, both of Bristol; Michael J. Tracey, Cromwell; Valery G. Sheynkman, West Hartford; Duane R. Stupienski, Granby; Blair J. Cohen, Manchester, all of Conn., now by change of name from Blair J. Zalcman

[73] Assignee: Otis Elevator Company, Farmington, Conn.

[21] Appl. No.: 672,283

[22] Filed: Jun. 28, 1996

Related U.S. Application Data

[63] Continuation-in-part of Ser. No. 630,793, Apr. 10, 1996, abandoned.

[51] Int. Cl.[6] ..... B66B 13/14

[52] U.S. Cl. ..... 187/314; 187/335

[58] Field of Search ..... 187/314, 335, 187/331; 49/116, 120

[56] References Cited

U.S. PATENT DOCUMENTS

| | | | |
|---|---|---|---|
| 4,313,525 | 2/1982 | McDonald | 187/57 |
| 4,491,200 | 1/1985 | Thompson et al. | 187/61 |
| 4,947,964 | 8/1990 | Husmann | 187/314 |

FOREIGN PATENT DOCUMENTS

| | | |
|---|---|---|
| 0332841 | 2/1989 | European Pat. Off. . |
| 0513509 | 4/1992 | European Pat. Off. . |
| 2112352 | 7/1983 | United Kingdom . |

*Primary Examiner*—Kenneth Noland

[57] ABSTRACT

A simplified elevator car door lock assembly locks an elevator car door if the car is outside a landing zone and there is an attempt to open those doors. The car doors are connected to the hoistway doors by a pair of vanes mounted on the car door and a pair of rollers mounted on the hoistway door. A third vane is attached to the car door and follows a cam path on the car door to lock the car doors if the car is not in a landing zone. Conversely, the third vane senses if the car is in a landing zone and does not lock the car door if it is moved.

8 Claims, 5 Drawing Sheets

FIG.2
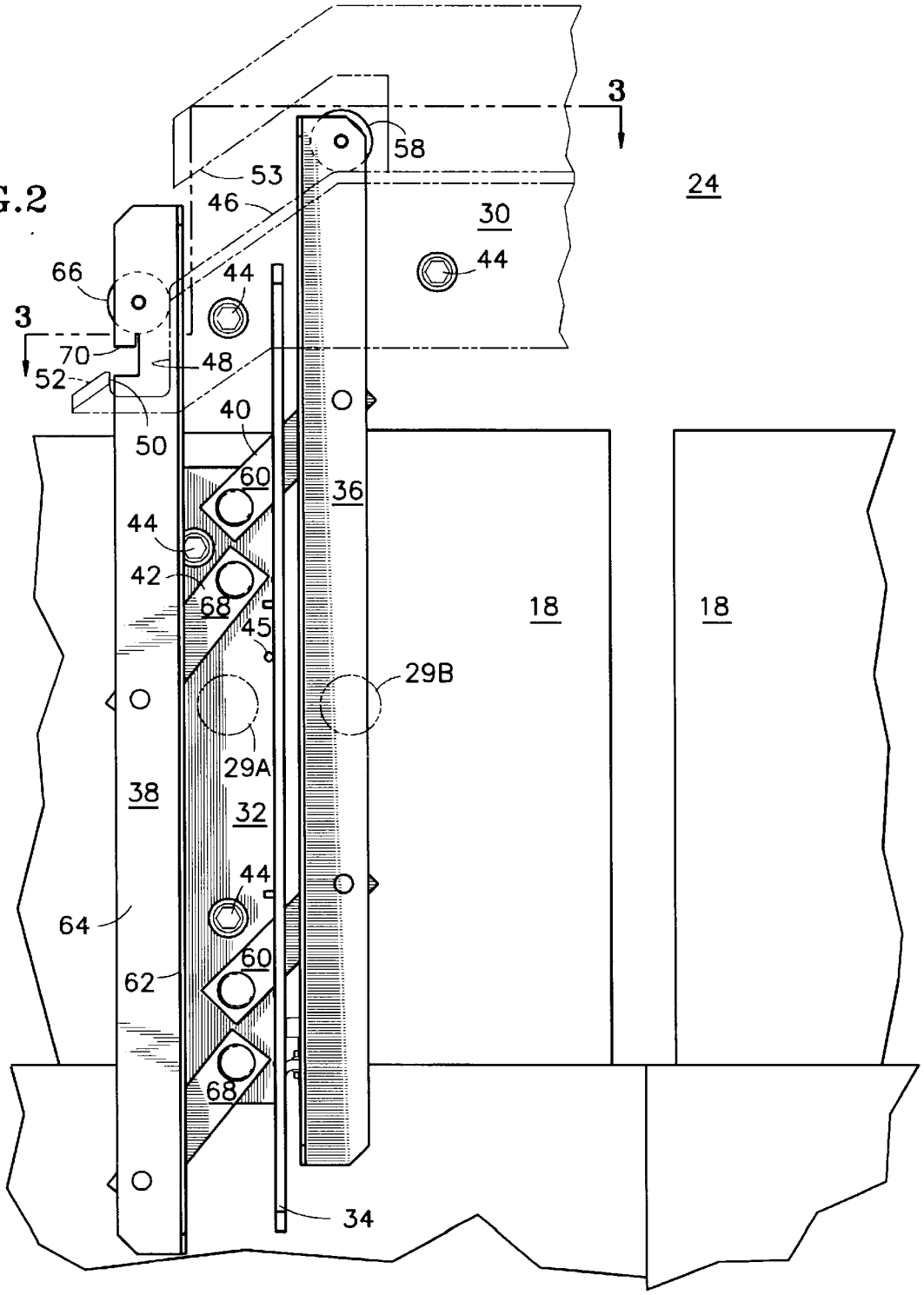
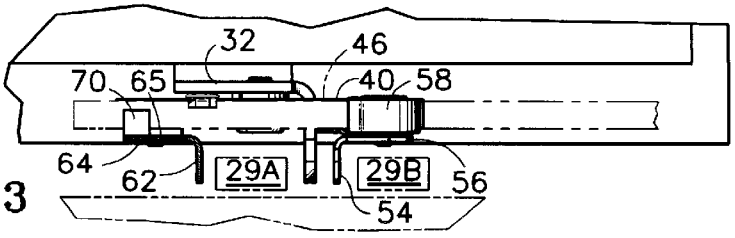
FIG.3

ELEVATOR EVACUATION DETERRENT DEVICE

CROSS REFERENCE

This application is Continuation-in-Part application of U.S. Ser. No. 08/630,793 now abandoned; filed on Apr. 10, 1996; entitled "Elevator Evacuation Deterrent Device", James A. Rivera, et al.

TECHNICAL FIELD

This invention relates to elevator car door operation and, more particularly, to a device that prevents the opening of an elevator car door if the car is not at a landing.

BACKGROUND ART

Elevator door opening systems coordinate the opening and closing movement of the car door and the hoistway door in an elevator assembly. Typically, the hoistway door is latched closed from inside the hoistway. The elevator car carries a motor that operates the car door or doors when the car stops at a landing. The motor holds the car doors closed until activated to a door-opening stroke. There is a make and break connection utilizing vanes and rollers between the car door and the hoistway door whereby movement of the car door results in the unlatching and opening of the hoistway door, with the movement being controlled by a door operator on the car. Thus there is a connection between the car and hoistway doors when the doors are opening or closing, and there is no such connection when the car is moving through the hoistway.

Various elevator codes require that car doors not open from the inside if the car is not in a landing zone. Some elevators utilize a cam surface mounted on the car and connected to the door operator. The cam surface is used to unlock the hoistway doors. If the car is in a landing zone, the door operator lowers the cam into contact with a hoistway locking linkage that unlocks the hoistway doors. The car also carries a second mechanical linkage that follows the motion of the cam surface to lock the car doors. If the car is in a landing zone, the cam can only move a certain distance because it contacts the hoistway locking linkage. In this circumstance, the second mechanical linkage does not move far enough to lock the car doors. Outside the landing zone, however, if a passenger tries to open the door, the cam surface, through its attachment to the door operator, moves farther because it does not contact the hoistway locking linkage. The second mechanical linkage then moves enough to mechanically lock the car doors from opening.

DISCLOSURE OF THE INVENTION

It is therefore an object of this invention to prevent passengers from leaving an elevator car that is not in a landing zone.

It is an additional object of this invention to provide an assembly for efficiently latching an elevator car door if the car door is not in a landing zone.

It is an additional object of this invention to provide an elevator car door latch assembly that is easy to install on an elevator car.

It is a further object of this invention to provide an assembly of the character described wherein the car door latch assembly that is easy to retrofit in a hoistway.

It is another object of this invention to provide an assembly of the character described which is rugged, uncomplicated and reliable in operation.

The elevator car door latching assembly of this invention provides a simplified door lock assembly that locks an elevator car door only if the car is outside a landing zone and there is an attempt to open those doors. The car doors are connected to the hoistway doors by a pair of vanes mounted on the car door and a pair of rollers mounted on the hoistway door. A third vane is attached to the car door and follows a cam path on the car door to lock the car doors if the car is not in a landing zone. Conversely, the third vane senses if the car is in a landing zone by contacting the roller and does not lock the car door if it is moved.

In an alternate embodiment, the pair of vanes mounted on the car door include a pivoting sensing vane and a stationary vane. Fixed to the sensing vane is an extension having a roller. The roller, and thereby the extension and the sensing vane, follows a cam path on the locking brackets. If the car is not in a landing zone, the roller follows the cam path until it engages a catch, which prevents further movement of the doors. If the car is in the landing zone, the roller mounted on the hoistway door stops the sensing vane from pivoting such that the roller does not engage the catch and thereby permitting the doors to open.

These and other objects and advantages of the invention will become more readily apparent to those skilled in the art from the following detailed description of a preferred embodiment thereof when taken in conjunction with the accompanying drawings, in which:

BRIEF DESCRIPTION OF THE DRAWINGS

FIG. 2 is a perspective view of the elevator evacuation deterrent device of FIG. 1 in a traveling zone;

FIG. 3 is a top view of the elevator evacuation deterrent device taken along line 3—3 of FIG. 2:

BEST MODE FOR CARRYING OUT THE INVENTION

Figure 1:
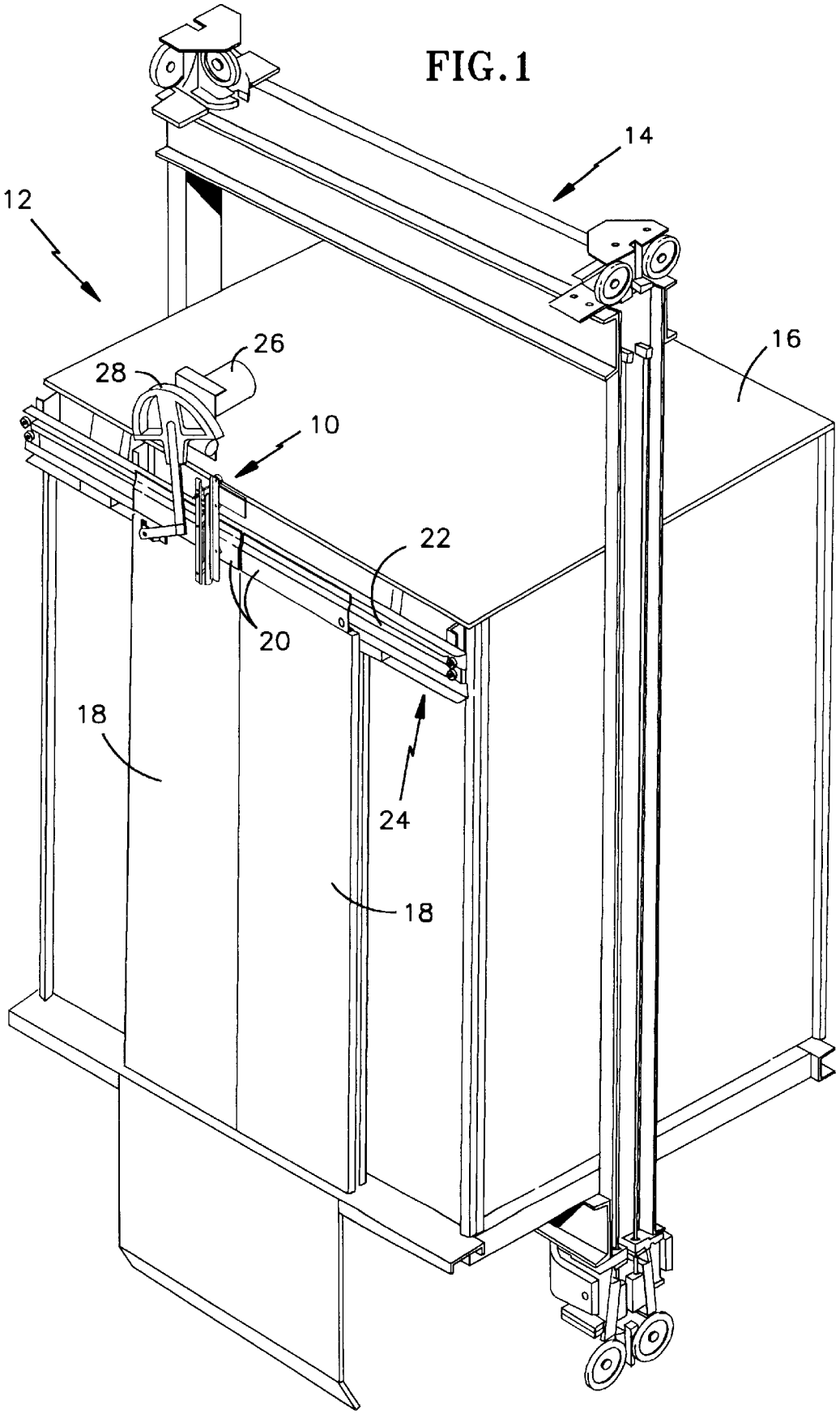
FIG. 1 is a perspective view of an elevator system incorporating the elevator evacuation deterrent device of the invention.

Referring to FIG. 1, the evacuation deterrent device 10 (one of which is shown for ease of illustration) of the invention is shown in its environment. Elevator 12 is comprised of a frame 14, a car 16 disposed within the frame, a pair of car doors 18, a pair of car door hangers 20, each of the pair attaching to a door and a door track 22, a header 24 attached to the top of the car for mounting the door track, a door operator 26, a linkage 28 attaching the door operator to each door so that motion of the door operator causes the door to open and close, as is known in the art. The elevator car moves in travel zones and stops at landing zones (not shown). In the landing zones, the car doors interact with a pair of rollers 29A and 29B (shown in phantom in FIGS. 2, 3 and 4) to open hoistway doors (not shown) as is known in the art.

Referring to FIGS. 2 and 3, one of the evacuation deterrent devices 10 is shown. The device lock comprises, for each car door 18, a cammed catch 30 attaching to the header 24, a mounting plate 32, a stationary vane 34, a coupling vane 36, a sensing vane 38, a first linkage 40 attaching the coupling vane to the mounting plate and a second linkage 42 attaching the sensing vane to the mounting plate.

Each cammed catch 30 is stationarily attached to the header 24 by conventional means such as bolts 44 or the like. Each cammed catch has: a first cam surface 46 extending at about a 30° angle from horizontal; a second cam surface 48 that intersects and extends downwardly from the first cam surface normal to horizontal; a catch surface 50 extending parallel to the second cam surface below the first cam surface; a third cam surface 52 that extends at about 30° from horizontal and intersects the top of the catch surface and a fourth cam surface 53 arranged above and parallel to the first cam surface 46.

The mounting plate 32 is attached to a car door 18 by conventional means such as bolts 44 or the like. The stationary vane 34 is a long, thin, rectangular piece that is integrally formed with the mounting plate and extends at a 90° angle therefrom. A pin 45 extends from the mounting plate in proximity to the second linkage 42 as will be discussed infra.

The coupling vane 36 is an angle iron having a first flange 54 (see FIG. 3) for engaging a hoistway door roller 29 and a second flange 56 for attaching to the first linkage 40. The first and second flanges attach to each other at a 90° angle. The second flange 56 has a first roller 58 rotatably mounted to a back face thereof for being guided along the first cam surface 46 of the cammed catch 30, as will be discussed infra. The first linkage 40 is comprised of a conventional four bar linkage having a pair of arms 60, each arm conventionally and rotatably attaching at one end to the mounting plate 32 and at a second end to the first flange 56 so that the coupling vane is free to pivot as the first roller 58 travels along the first cam surface. The coupling vane is mounted in parallel and to one side of the stationary vane 34.

The sensing vane 38 is an angle iron having a third flange 62 for engaging a hoistway door roller 29 (see FIG. 3) and a fourth flange 64 for attaching to the second linkage 42—the flanges attaching to each other at a 90° angle. The fourth flange 64 has a second roller 66 rotatably mounted to a back face 65 thereof for being guided along the second cam surface 48 of the cammed catch, as will be discussed infra. The second linkage 42 is a conventional four bar linkage having a pair of arms 68, each arm conventionally and rotatably attaching at one end to the mounting plate 32 and at a second end to the third flange 64 so that the sensing vane is free to pivot. The sensing vane is mounted in parallel and to another side of the stationary vane 34. The back face 65 has a bent latch 70 extending therefrom and disposed below the second roller to engage the catch surface 50 as will be discussed infra.

In operation, as the car doors 18 close, the first roller 58 engages the first cam surface 46 of the cammed catch. The first roller causes the coupling vane 36 to rotate upwardly out of contact with a first hoistway roller 29B. Similarly, the second roller 66 engages the second cam surface 48 causing the sensing vane 38 to rotate upwardly out of contact with a hoistway roller 29A. The sensing vane rotates upwardly far enough so that the latch 70 is above and does not engage the catch surface 50. As the door continues to close the stationary flange 34 loses contact with the hoistway roller 29A. Enough running clearance is thereby established to allow the car to travel in the travel zones without contacting the vanes.

Figure 4:
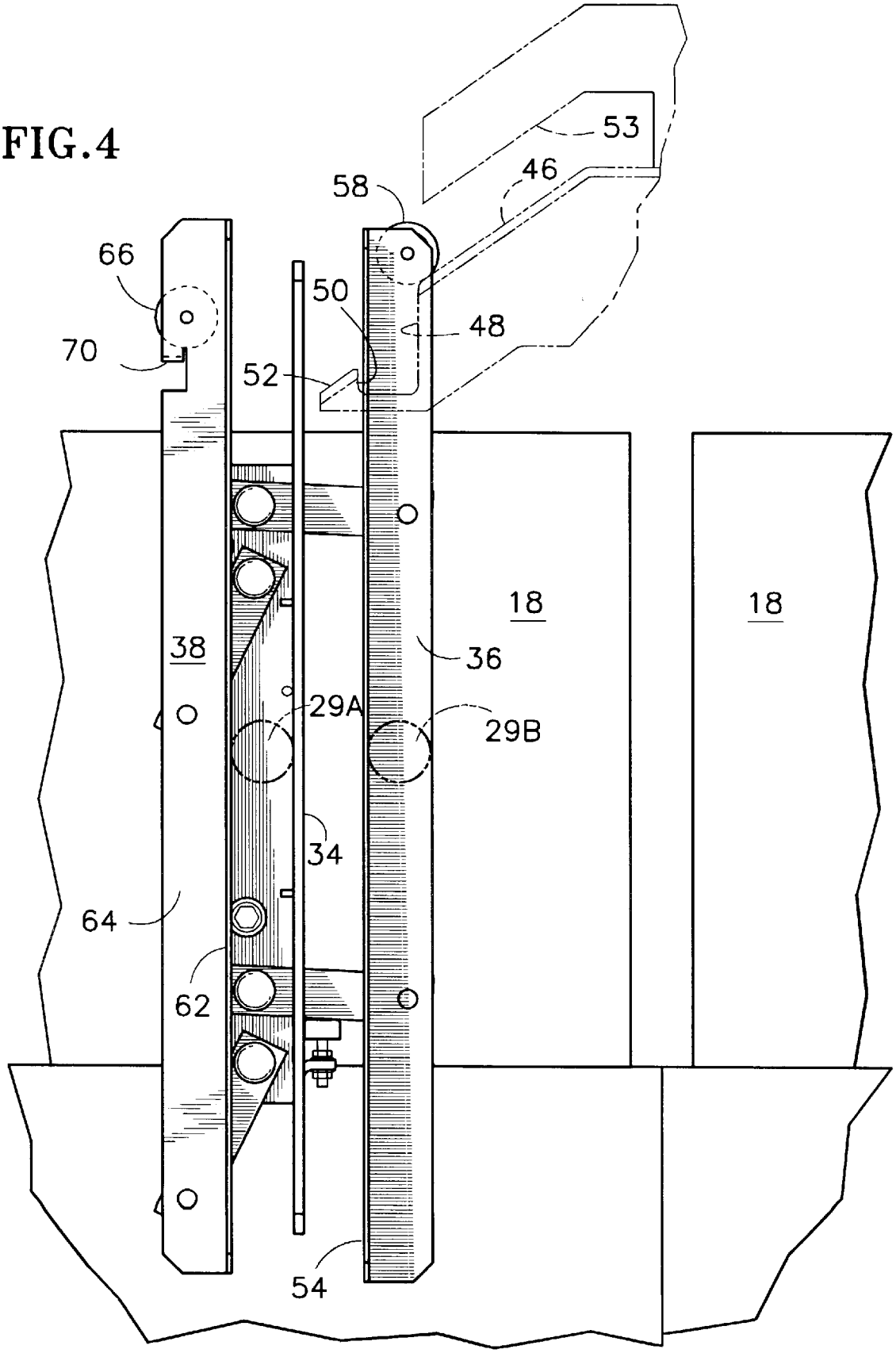
FIG. 4 is a perspective view of the elevator evacuation deterrent device of FIG. 1 in a coupled position in a landing zone.

Referring to FIG. 4, as the car doors 18 open in a landing zone the first roller 58 travels downwardly along the first cam surface 46 of the cammed catch. The first roller, in conjunction with gravity, causes the coupling vane 36 to rotate downwardly into contact with a hoistway roller 29B. If the coupling vane fails to descend, the roller 58 will contact the fourth cam surface 53 thereby forcing the coupling vane downwardly. As the door continues to open, the stationary flange 34 makes contact with a hoistway roller 29A. The second roller 66 follows the second cam surface 48 causing, in conjunction with gravity, the sensing vane 38 to rotate downwardly into contact with a hoistway roller 29A. The contact of the stationary and coupling vanes with the hoistway rollers causes each hoistway door to open with the corresponding car door. Because the third flange 62 of the sensing vane contacts and senses the hoistway roller, the latch 70 does not descend far enough to contact the catch surface 50 thereby allowing the car and connected hoistway doors to open.

Figure 5:
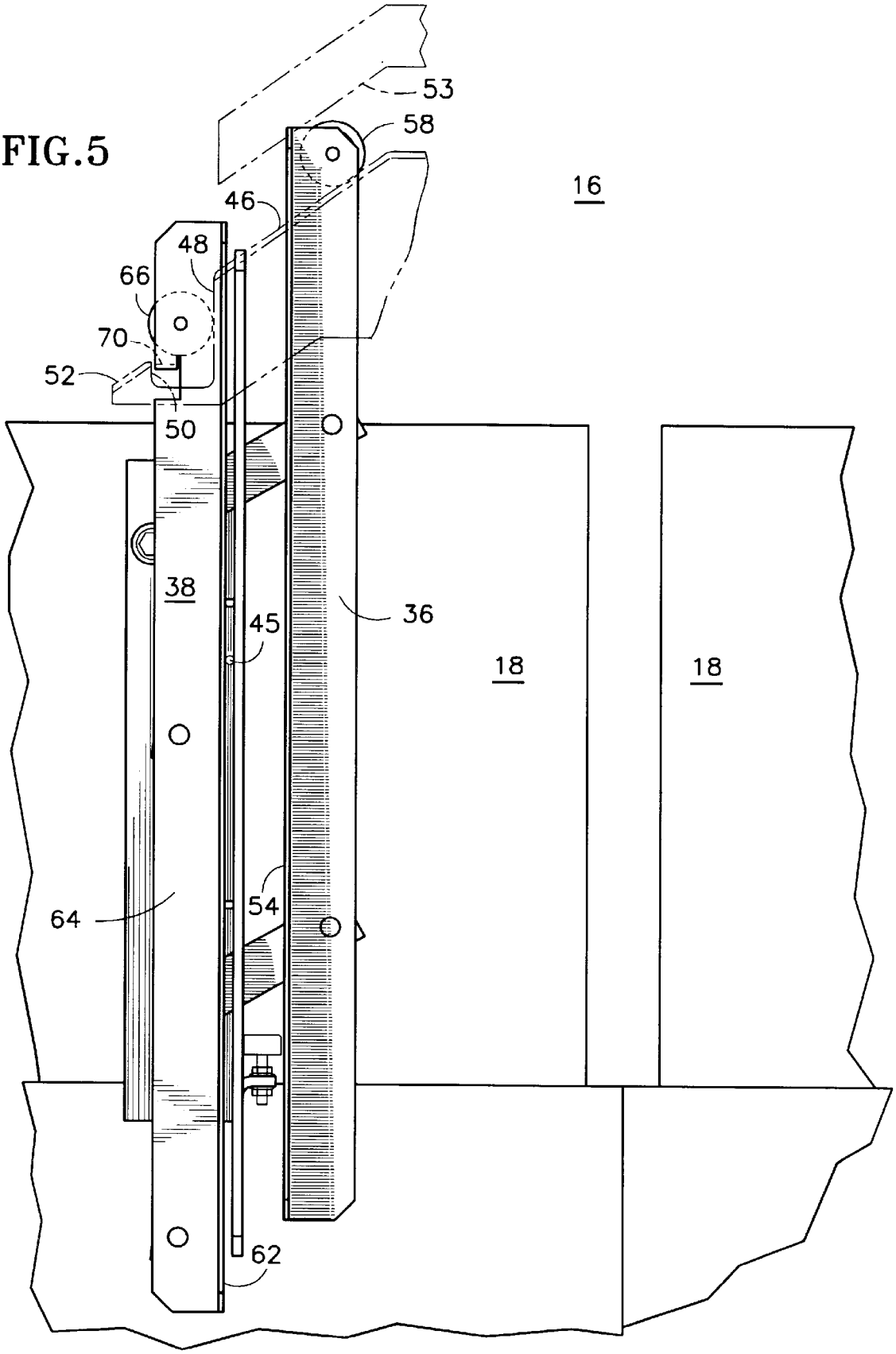
FIG. 5 is a perspective view of the elevator evacuation deterrent device of FIG. 1 in a traveling zone and evacuation is attempted.

Referring to FIG. 5, if the car 16 is outside a landing zone and passengers try to get out of the car by opening the car doors 18, the following occurs: the second roller 66 follows the second cam surface 48 of the cammed catch causing the sensing vane 38 to rotate downwardly; the third flange 62 does not engage the hoistway door rollers 29A because the car is outside a landing zone where the hoistway door rollers are mounted; and, the latch 70 descends in conjunction with gravity to engage the catch surface 50 of the cammed catch thereby effectively preventing further movement of the car door. The passengers can not then leave the car by opening the car doors.

If a mechanic wishes to open the car doors outside of the landing zone, he or she only has to rotate the sensing vane 38 upwardly so that the latch 70 no longer engages the catch surface 50. To reset the system, the mechanic merely closes the doors—the latch 70 engages and follows the third cam surface 52 until the second roller 66 is in contact with the second cam surface 48. The pin 45 prevents the second linkage 42 from traveling over-center thereby making it easier to reset the sensing vane as it contacts the camming surfaces 52 and 48.

Figure 6C:
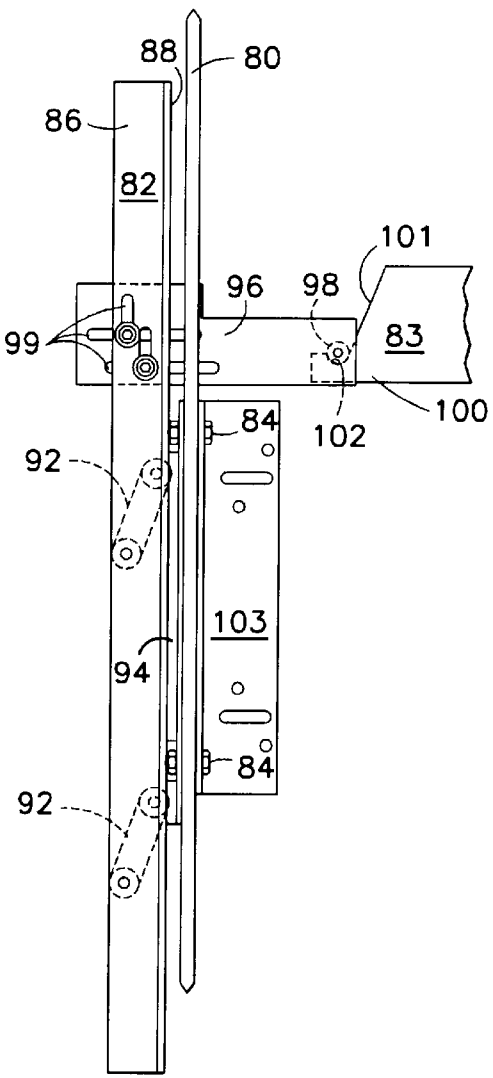
FIGS. 6*a,* 6*b* and 6*c* are views of an alternate embodiment of the invention in the traveling zone, in a coupled position in the landing zone, and in a traveling zone and evacuation is attempted.
Figure 6B:
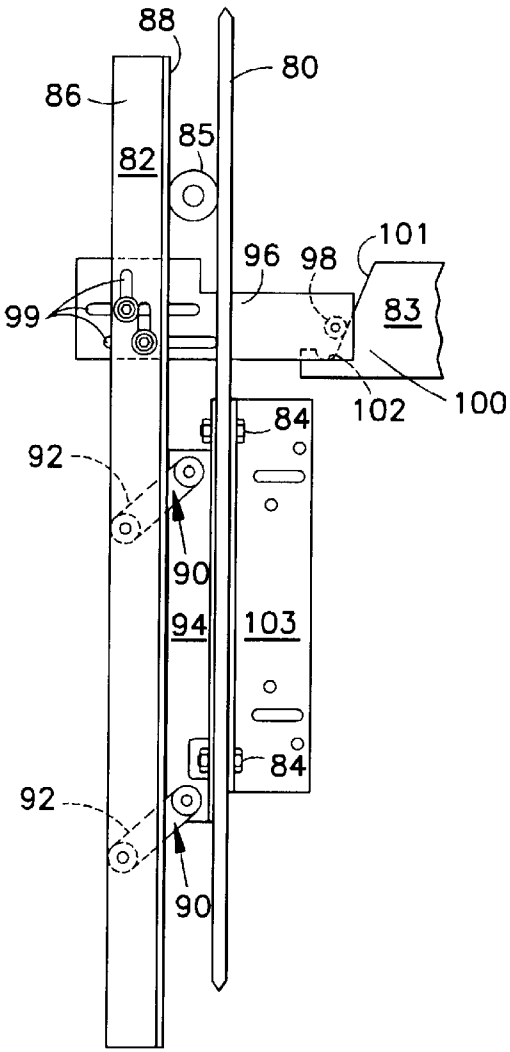
Figure 6A:
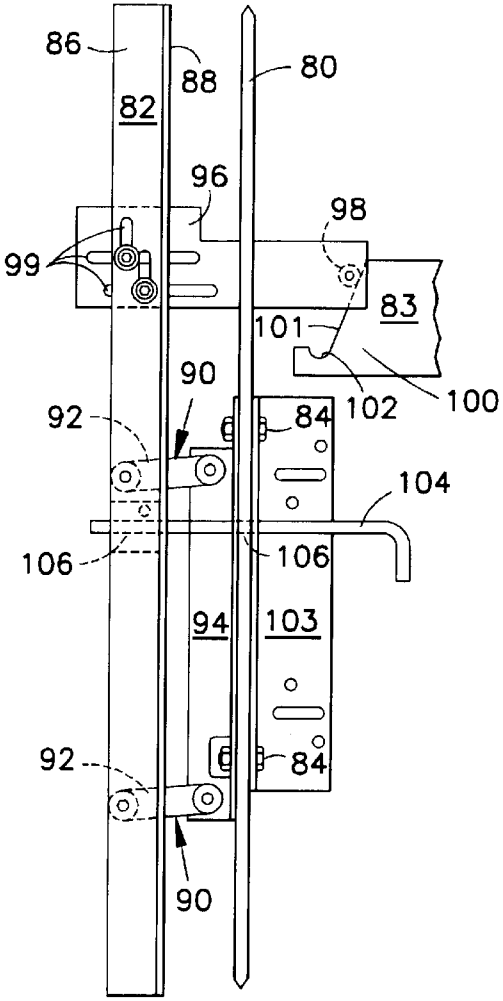

An alternate embodiment of the invention is shown in FIGS. 6 *a–c*. In this embodiment, there is only a stationary vane 80 and a sensing vane 82 engaged with the locking bracket 83 and the hoistway door roller 85. No third vane, as shown in FIGS. 1–5 is necessary.

The stationary vane 80 is attached to the door via a pair of bolts 84 fixing it to a mounting plate 103. The mounting plate 103 is fixed to the door, such as by bolting or other means of fastening.

The sensing vane 82 includes a first flange 86 and a second flange 88. The first flange 86 is pivotally connected to a linkage 90 having a pair of arms 92. The arms 92 are pivotally connected to a sensing vane plate 94, which is bolted to the mounting plate 103 and stationary vane 80. The sensing vane 82 also includes an extension 96 having a roller 98. The extension is bolted to the sensing vane 82 and the sensing vane 82 and extension 96 include cut-outs 99 for adjusting the relative position of the extension 96 and roller 98. The cut-outs 99 permit the deterrent device to be fit to a variety of door systems having different relative dimensions.

The locking bracket 83 includes a cammed catch 100 having a cam surface 101 and a catch surface or notch 102. The locking bracket 83 is fixed to and moves with the door opposite the door having the vanes 80,82. Although shown and described as used with center opening elevator doors, the device may also be used with single, slide opening doors by placing the locking bracket in a fixed position relative to the vanes attached to the moving door.

Referring to FIG. 6*b*, if the car is in a landing zone and the doors begin to open, the vanes 80,82 move away from the locking bracket 83. This movement causes the roller 98 to travel down the cam surface 101 and the sensing vane to pivot downward. The hoistway door roller 85 engages the second flange 88 and the stationary vane 80 to stop the pivoting motion of the sensing vane 82. This event prevents the roller 98 from traveling down the cam surface 101 sufficiently to engage the notch 102. As a result, the doors may continue to open.

Referring to FIG. 6*c*, if the car is in a traveling zone and there is an attempt to open the doors, the following occurs: the vanes 80,82 move away from the cammed catch 100, the roller 98 travels down the cam surface 101, and, since there is no hoistway roller present to engage the second flange 88 and the stationary vane 80, the roller travels into the notch 102 and prevents further motion of the doors.

If a mechanic desires to open the doors outside of a landing zone, the sensing vane 82 only needs to be pivoted upward such that the roller 98 will not engage the notch 102. To maintain the sensing vane 82 in this position, a pin 104 may be inserted through apertures 106 in the stationary vane and sensing vane. Once the mechanic has completed the maintenance, the doors are closed and the pin is removed.

Since many changes and variations of the disclosed embodiment of the invention may be made without departing from the inventive concept, it is not intended to limit the invention otherwise than as required by the appended claims. for instance, of ordinary skill in the art will recognize that the sensing vane and the coupling vane may pivot on one four bar linkage. One of ordinary skill in the art will recognize that the sensing vane and the coupling vane may be mounted by one four bar linkage rotating about a pair of pivot points. One of ordinary skill in the art will also recognize that the sensing vane, cammed catch and a member performing the function of the hoistway roller (for contacting the sensing vane in a landing zone) may be mounted independently of the stationary and coupling vanes and the hoistway rollers.

What is claimed is:

1. An emergency evacuation deterrent device for use in an elevator system having a car having a car door, a landing zone at each stop, a traveling zone between stops, a landing door at each landing zone, a pair of engagement rollers disposed on the landing door, and a pair of engagement vanes on the car door for engaging the engagement rollers, said device comprising:

a catch on the car said catch having a cam surface and a catch surface adjacent said cam surface, wherein said cam surface comprises:

a first slope to guide said vane such that said latch contacts said catch surface if said car door is being opened in the traveling zone and, a second slope to guide said vane into one of said rollers if said car is in said landing zone thereby preventing said vane being guided by said first slope, and a third vane having a latch for engaging said catch surface and a follower for following said cam surface, said vane being moveably attached to said door to enable said follower to follow said cam surface in a first manner so that said third vane engages one of said rollers and said latch does not engage said catch surface if said car is in a landing zone and said door is being opened, and a second manner so that said vane does not engage one of said rollers and said latch does engage said catch surface if said car is in a traveling zone and if the car door is opened a distance.

2. An emergency evacuation deterrent device for use in an elevator system having a car having a car door, a landing zone at each stop, a traveling zone between stops, a landing door at each landing zone, said device comprising:

a member mounted in said landing zone, a catch on the car said catch having a cam surface and a catch surface adjacent said cam surface, wherein said cam surface comprises:

a first slope to guide said vane such that said latch contacts said catch surface if said car door is being opened in the traveling zone and, a second slope to guide said vane into said member if said car is in said landing zone thereby preventing said vane being guided by said first slope, and a vane having a latch for engaging said catch surface and a follower for following said cam surface, said vane being moveably attached to said door to enable said follower to follow said cam surface in a first manner so that said vane engages said member and said latch does not engage said catch surface if said car is in a landing zone and said door is being opened, and a second manner so that said latch does engage said catch surface if said car is in a traveling zone and if the car door is opened a distance.

3. An evacuation deterrent device for use in an elevator system having a car having a car door, a landing zone at each stop, a traveling zone between stops, a landing door at each landing zone, a coupling disposed on the landing door, and means on the car door for engaging the coupling, the device including:

a catch on the car, the catch having a cam surface and a catch surface;

following means disposed on the car door for following the cam surface; and latching means disposed in a fixed relationship to the following means and adapted to engage the catch surface upon sufficient motion of the following means relative to the cam surface, wherein the coupling prevents such sufficient motion of the following means when the car is in a landing zone.

4. The deterrent device according to claim 3, further including a roller that engages the cam surface to define the following means and that is engageable with the catch surface to define the latching means.

5. The deterrent device according to claim 3, wherein the following means includes a roller engaged with the cam surface and the latch means includes a latch engageable with the catch surface.

6. The deterrent device according to claim 3, further including a vane pivotally attached to the door and connected to the following means, wherein the pivoting motion of the vane is guided by the engagement between the following means and the cam surface, and wherein the vane is engageable with the coupling when the car is in the landing zone such that pivoting motion of the vane, and thereby motion of the following means along the cam surface, is stopped.

7. The deterrent device according to claim 6, further including an extension that connects the following means and the vane in a fixed relationship, wherein the extension is adjustable in position relative to the vane.

8. The deterrent device according to claim 6, further including a stationary vane disposed on the door, the stationary vane including an aperture, wherein the pivoting vane includes an aperture, the apertures positioned such that a pin may be inserted through the apertures to retain the pivoting vane in a position to prevent engagement between the latching means and the catch surface.

* * * * *